US005196889A

United States Patent [19]

Ronnenberg et al.

[11] Patent Number: 5,196,889

[45] Date of Patent: Mar. 23, 1993

[54] APPARATUS FOR APPLYING AN ELECTRICAL BIAS TO A SHELL OF A MAGNETIC BRUSH

[75] Inventors: Robert J. Ronnenberg; Satyan R. Kalyandurg, both of Rochester, N.Y.; John M. Fiske, Medford, Mass.

[73] Assignee: Eastman Kodak Company, Rochester, N.Y.

[21] Appl. No.: 830,828

[22] Filed: Feb. 4, 1992

[51] Int. Cl.[5] ..... G03G 15/06

[52] U.S. Cl. ..... 355/259; 355/219; 355/246; 355/261; 118/656; 118/661

[58] Field of Search ..... 355/250, 251, 259, 261, 355/263, 301, 303, 246, 219, 245; 118/647, 649, 651, 656-658, 661

[56] References Cited

U.S. PATENT DOCUMENTS

| | | | |
|---|---|---|---|
| 4,128,328 | 12/1978 | Matsui | 355/251 |
| 4,205,622 | 6/1980 | Miyake et al. | 118/661 |
| 4,397,539 | 8/1983 | Normand | 355/251 |

FOREIGN PATENT DOCUMENTS

| | | | |
|---|---|---|---|
| 0119154 | 9/1981 | Japan | 355/261 |
| 0057158 | 4/1983 | Japan | 355/246 |
| 0153966 | 9/1983 | Japan | 118/651 |
| 0124075 | 5/1988 | Japan | 355/251 |
| 0188169 | 8/1988 | Japan | 355/246 |
| 0193164 | 8/1988 | Japan | 355/246 |

*Primary Examiner*—A. T. Grimley
*Assistant Examiner*—Matthew S. Smith
*Attorney, Agent, or Firm*—David A. Howley

[57] ABSTRACT

In accordance with the invention, there is provided a novel device for applying an electrical bias to a conductive shell of a magnetic brush in an image reproduction machine. The conductive shell is rotatable about an axis of rotation and has an end surface generally perpendicular to the axis. The machine includes a source of electrical bias and a bearing block adjacent the end surface. The bearing block defines an opening elongated generally in the direction of the axis. The opening has a wide portion toward the end surfaace, a narrow portion away from the end surface and a spring support surface facing the end surface into which the narrow portion opens. The device includes an elongated conductive member, a compression spring and a narrow conductive connecting piece. The spring is positioned in the wide portion between the spring support surface and the conductive member, and urges the conductive member out of the opening and into contact with the end surface. At least the spring is too large to pass through the narrow portion. The narrow conductive connecting piece is positioned in the narrow opening and connects the conductive member to the source of electrical bias.

13 Claims, 3 Drawing Sheets

APPARATUS FOR APPLYING AN ELECTRICAL BIAS TO A SHELL OF A MAGNETIC BRUSH

TECHNICAL FIELD OF THE INVENTION

The present invention relates generally to image reproduction machines and specifically to a device for applying an electrical bias to a shell of a magnetic brush utilized in such a machine.

BACKGROUND ART

In a typical electrostatographic copying machine, a photoconductive surface has a uniform charge applied to it. The surface is then imagewise exposed to light to selectively discharge the surface through a grounded conductive layer, leaving behind an electrostatic latent image on the photoconductive surface. This latent image is developed with toner particles to form a visible image. The visible image is transferred to a receiver sheet to which the visible image is permanently fixed by fusing it with heat and/or pressure. To prepare the photoconductive surface for the next copying cycle, the surface is cleaned by a cleaning station. This cleaning station removes debris, such as background toner, dirt and receiver sheet fibers, from the surface.

The step of developing the latent image may be performed with a magnetic brush. Such a brush includes a core composed of a series of radially mounted, alternating pole magnets. The magnets are surrounded by a cylindrical shell made of a nonmagnetic, conductive material. Relative movement is provided between the core and the shell by rotating the core and/or the shell. Developer material, made up of magnetic carrier particles and toner particles, is applied to the shell. The toner and carrier particles are triboelectrically charged to opposite signs and are thus attracted to each other. The developer material adheres to the shell due to the carrier particles' attraction to the magnetic core.

To control attraction of the toner particles to the latent image on the photoconductive surface, an electrical bias is applied to the shell. This bias sets up an electric field between the shell and the latent image. The toner particles, under the influence of the electric field, leave the shell and adhere to the photoconductive surface in a pattern corresponding to the latent image. This creates a visible image of toner.

If the shell is rotated, one method of applying the electrical bias to the shell is through the use of a brass brush connected to a voltage supply. The brass brush has a ⅜" bristle and bears directly on the shell surface. A problem with this setup is that the brass brush becomes contaminated with developer material. The brush wears out quickly in the abrasive atmosphere of the developer material, necessitating frequent replacement of the brush. Additionally, as the developer material is somewhat electrically insulative, it can hinder the electrical contact between the brush and the shell.

Another method of applying the electrical bias to the shell is to apply it through metal gears used to drive the shell. The bias is applied to a motor-gear (held by a suspended plastic arm) through its bearing and shaft. The motor-gear meshes with a gear mounted on the shell. The disadvantage of this system is that, as the gears rotate, the electrical path becomes broken when the gears mesh and when backlash occurs.

SUMMARY OF THE INVENTION

In view of the foregoing discussion, an object of this invention is to provide a device for applying an electrical bias to a rotating shell of a magnetic brush which overcomes the deficiencies of the prior art.

In accordance with the invention, there is provided a novel device for applying an electrical bias to a conductive shell of a magnetic brush in an image reproduction machine. The conductive shell is rotatable about an axis of rotation and has an end surface generally perpendicular to the axis. The machine includes a source of electrical bias and a bearing block adjacent the end surface. The bearing block defines an opening elongated generally in the direction of the axis. The opening has a wide portion toward the end surface, a narrow portion away from the end surface and a spring support surface facing the end surface into which the narrow portion opens. The device includes an elongated conductive member, a compression spring and a narrow conductive connecting piece. The spring is positioned in the wide portion between the spring support surface and the conductive member, and urges the conductive member out of the opening and into contact with the end surface. At least the spring is too large to pass through the narrow portion. The narrow conductive connecting piece is positioned in the narrow opening and connects the conductive member to the source of electrical bias.

In a preferred embodiment of the invention the conductive member is made of carbon.

This device is very reliable, providing constant voltage to the shell. Because the device is located at an end of the shell, the conductive member is not exposed to the abrasive atmosphere of the developer material.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 1:
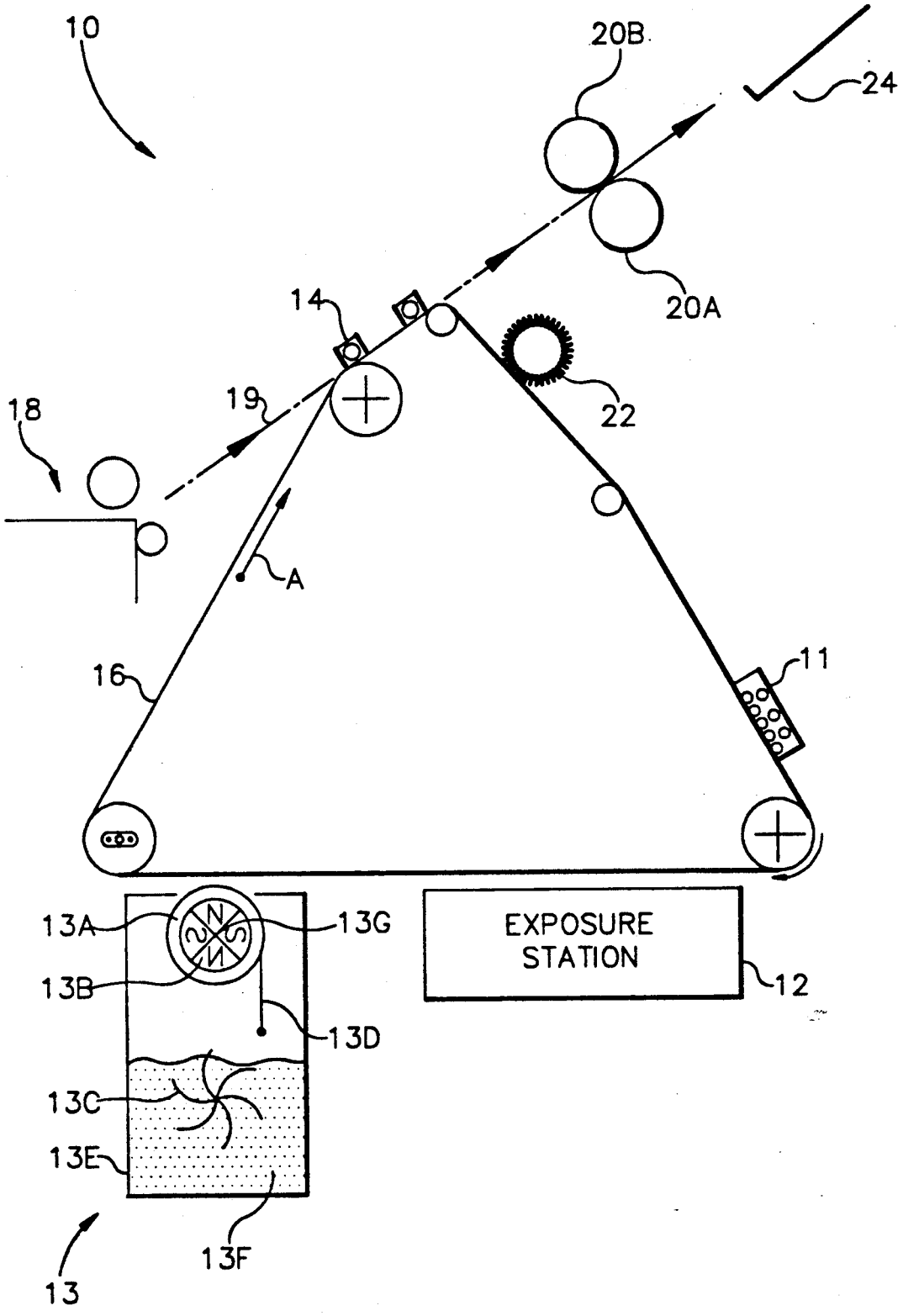
FIG. 1 is a side schematic view of an electrophotographic copier.

The present invention will be described with respect to an electrophotographic copier which is designated generally by the reference numeral 10 in FIG. 1. An endless web 16, having a photoconductive outer surface and a grounded conductive layer, is rotated in the direction of an arrow A about a fixed path. A corona charger 11 applies a uniform electric charge to the photoconductive surface. An exposure station 12 imagewise exposes the photoconductive surface to light. This exposure discharges the surface where light strikes it, leaving behind an electrostatic latent image.

A toning station, designated generally by the reference numeral 13, develops the latent image with colored marking particles called toner. A supply of developer mix 13F, which includes magnetic carrier particles and toner particles, is contained in a housing 13E. A rotating paddle 13C mixes the developer mix, causing the toner and carrier particles to triboelectrically charge to opposite polarities and thus be attracted to each other. A nonmagnetic, conductive shell 13A, mounted for rotation about an axis 13G, surrounds a rotatably mounted magnetic core. The core includes a series of radially mounted, alternating pole magnets. During operation of magnetic brush 13 the shell and/or core are rotated such that there is relative movement between the two.

The paddle, by rotation, supplies developer mix to the surface of shell 13A. The developer mix adheres to the shell due to the carrier particles' attraction to core 13B. An electrical bias of preferably several hundred volts is applied to the shell. The polarity and magnitude of this bias are selected such that an electric field is established between shell 13A and the electrostatic latent image on web 16. Toner particles, under the control of this electric field, are attracted from the carrier particles on shell 13A to the electrostatic latent image portions of web 16. This creates a visible image of toner on the web.

A receiver sheet, such as a plain piece of paper, is fed from a receiver sheet supply 18 along a path 19 and onto web 16. The feed is such that the receiver sheet overlies the visible image of toner. A transfer charger 14 is utilized to transfer the visible image from the web to the receiver sheet. The receiver sheet continues along path 19 to a heated fusing roller 20A and a pressure roller 20B. These rollers apply heat and pressure to permanently fix the visible image to the receiver sheet. Finally, the receiver sheet is deposited in an exit tray 24. In order to prepare the photoconductive surface for the next copying cycle, a cleaning brush 22 cleans the web surface of debris such as background toner, dirt and receiver sheet fibers.

Figure 2:
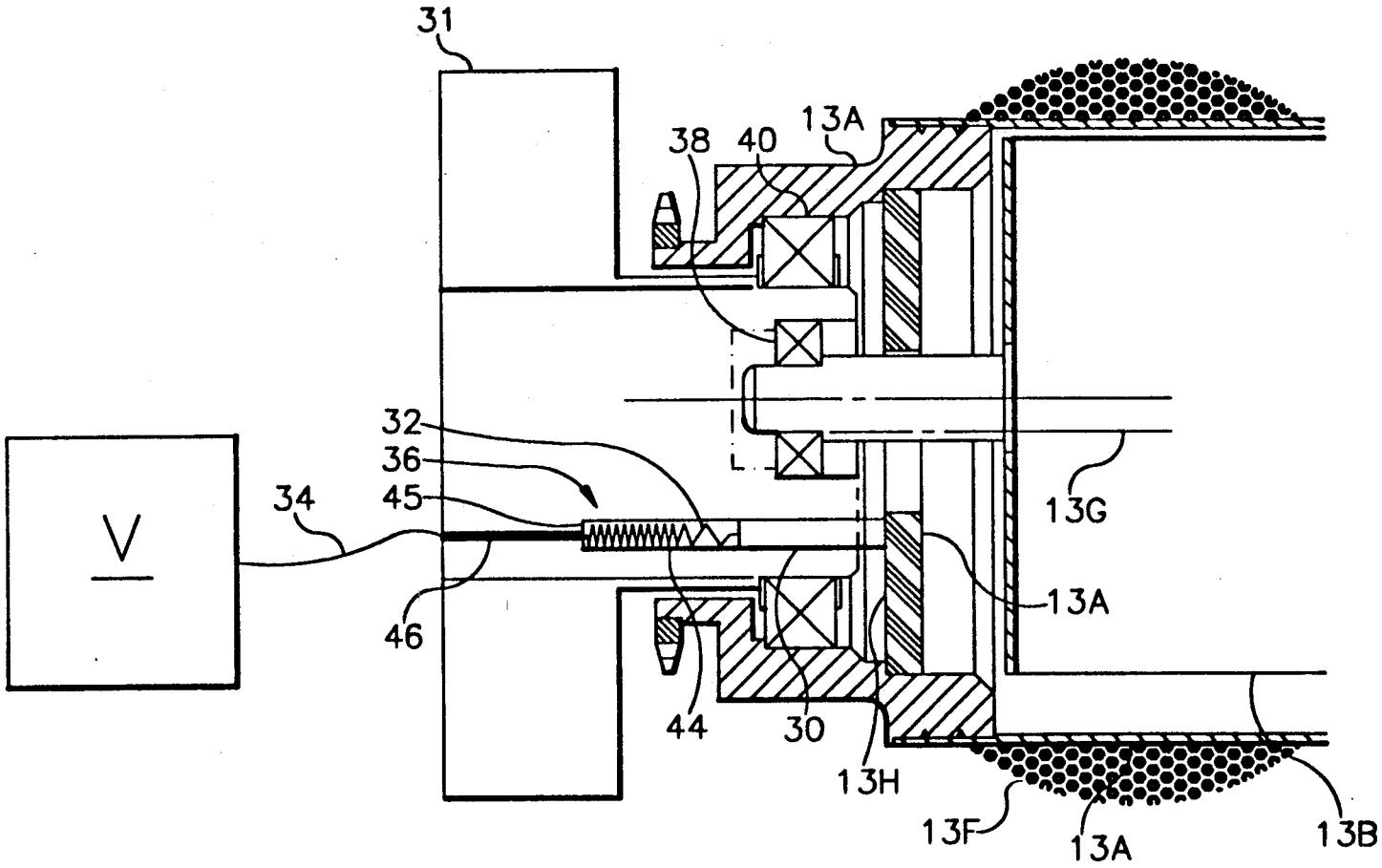
FIG. 2 is a side view of a magnetic brush.
Figure 3:
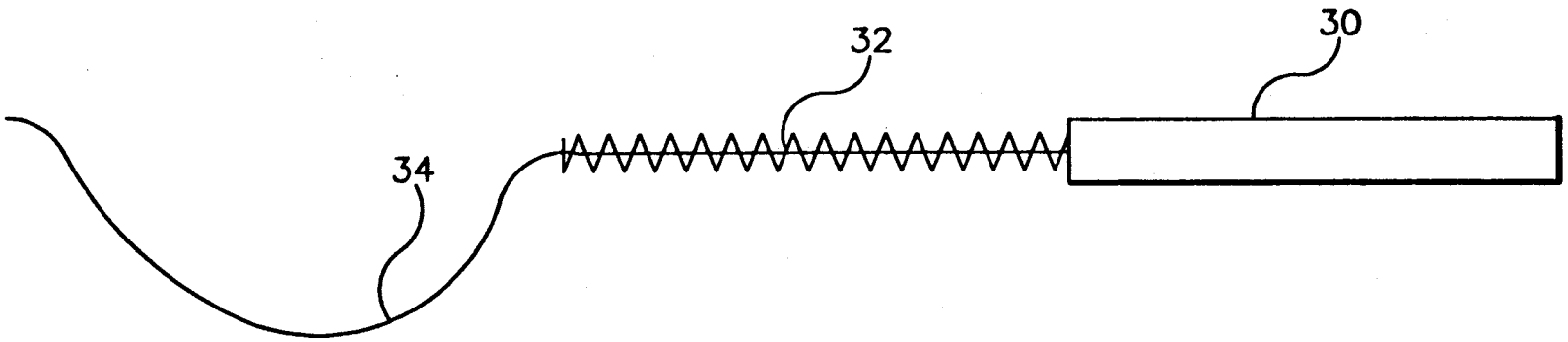
FIG. 3 is a side view of a device representative of the present invention

Referring to FIGS. 2 and 3, shell 13A has an end surface 13H which is generally perpendicular to axis 13G. A bearing block 31, preferably made of a rigid, nonconductive material such as plastic, is located adjacent end surface 13H. The bearing block contains a bearing 38 which supports core 13B. A second bearing 40 supports shell 13A. Bearing block 31 defines an opening ,designated generally by the reference numeral 36, which is elongated generally in the direction of axis 13G. Opening 36 has a wide portion 44 toward end surface 13H, a narrow portion 46 away from the end surface and a spring support surface 45 facing end surface 13H into which narrow portion 46 opens.

An elongated conductive member 30 and a compression spring 32 are positioned in wide portion 44. The conductive member may be in the shape of, for example, a rectangular block or a cylinder and preferably is made of carbon. The spring is positioned between spring support surface 45 and conductive member 30. Spring 32 urges member 30 out of opening 36 and into contact with end surface 13H with a force of between about 0.10 to 0.15 pounds. At least spring 32 is too large to pass through narrow portion 46. A narrow, conductive connecting piece 34 is positioned in narrow portion 46 for connecting conductive member 30 to a source of electrical bias V. Preferably, piece 34 is a conductive wire which is electrically isolated by covering it with an electrically insulating coating. This device provides a consistent electrical path along which to supply an electrical bias from source V to shell 13A.

The advantage of this apparatus is that member 30 is removed from the insulating and abrasive atmosphere of the developer material. Rather than have member 30 contact the shell on the same surface where developer material 13F sits, the member contacts the shell at an end of the shell where there is no developer mix present. This greatly reduces the wear on member 30 while allowing excellent electrical contact. In ongoing tests, the device continues to perform exceptionally well after over 5 million copies have been generated.

The invention has been described in detail with particular reference to preferred embodiments thereof, but it will be understood that variations and modifications can be effected within the spirit and scope of the invention. While the invention has been described in the context of a magnetic brush developer, it should be understood that the invention will function just as well in a magnetic brush cleaning apparatus. Furthermore, the present invention is also applicable in a magnetic brush which both develops and cleans.

What is claimed is:

1. Apparatus for applying toner to, and/or removing toner from, a surface, said apparatus comprising:

a conductive shell rotatable about an axis of rotation and having an end surface generally perpendicular to said axis;

a bearing block adjacent said end surface, said bearing block having an opening elongated generally in the direction of the axis, said opening having a wide portion toward said end surface, a narrow portion away from said end surface and a spring support surface facing said end surface into which said narrow portion opens;

an elongated conductive member, said end surface moving relative to said elongated conductive member when said conductive shell is rotated;

a compression spring positioned in the wide portion between the spring support surface and the conductive member, said spring urging said conductive member out of said opening and into contact with the end surface, said conductive member rubbing said end surface when said shell is rotated, at least said spring being too large to pass through the narrow portion; and a narrow conductive connecting means positioned in said narrow portion for connecting said conductive member to a source of electrical bias.

2. Apparatus of claim 1 wherein said elongated conductive member is comprised of carbon.

3. Apparatus of claim 2 wherein said bearing block is comprised of a rigid, nonconductive material.

4. Apparatus of claim 3 wherein said bearing block is comprised of plastic.

5. Apparatus of claim 1 wherein said bearing block is comprised of a rigid, nonconductive material.

6. Apparatus of claim 5 wherein said bearing block is comprised of plastic.

7. A device for applying an electrical bias to a conductive shell located in an image reproduction machine, the conductive shell being rotatable about an axis of rotation and having an end surface generally perpendicular to the axis, the machine including a source of electrical bias and a bearing block adjacent the end surface, the bearing block having an opening elongated generally in the direction of the axis, the opening having a wide portion toward the end surface, a narrow portion away from the end surface and a spring support surface facing the end surface into which the narrow portion opens, said device comprising:

an elongated conductive member, said end surface moving relative to said elongated conductive member when said conductive shell is rotated;

a compression spring positioned in the wide portion with the compression spring positioned between the spring support surface and the conductive member, and urging said conductive member out of said opening and into contact with the end surface, said conductive member rubbing said end surface when said shell is rotated, at least said spring being too large to pass through the narrow portion; and a narrow conductive connecting means positioned in said narrow portion for connecting said conductive member to said source of electrical bias.

8. The device of claim 7 wherein said elongated conductive member is comprised of carbon.

9. The device of claim 8 wherein said narrow conductive connecting means comprises a conductive wire, said wire being electrically isolated.

10. The device of claim 7 wherein said narrow conductive connecting means comprises a conductive wire, said wire being electrically isolated.

11. An implement for supporting a means for applying an electrical bias to a conductive shell located in an image reproduction machine, the conductive shell being rotatable about an axis of rotation and having an end surface generally perpendicular to the axis, the machine including a source of electrical bias, the applying means including a narrow conductive connecting means, an elongated conductive member, said end surface moving relative to said elongated conductive member when said conductive shell is rotated, and a compression spring, said implement comprising:

a bearing block adjacent said end surface, said bearing block having an opening elongated generally in the direction of the axis, said opening having a wide portion toward said end surface, a narrow portion away from said end surface and a spring support surface facing said end surface into which said narrow portion opens, said compression spring being positioned in the wide portion between the spring support surface and the conductive member, and urging said conductive member out of said opening and into contact with the end surface, said conductive member rubbing said end surface when said shell is rotated, at least said spring being too large to pass through the narrow portion, said narrow conductive connecting means being positioned in said narrow portion for connecting said conductive member to said source of electrical bias.

12. The implement of claim 11 wherein said bearing block is comprised of a rigid, nonconductive material.

13. The implement of claim 12 wherein said bearing block is comprised of plastic.

* * * * *